US011624586B2

(12) United States Patent
Gruner et al.

(10) Patent No.: US 11,624,586 B2
(45) Date of Patent: Apr. 11, 2023

(54) ADJUSTMENT APPARATUS OF A RETICLE DEVICE OF A TELESCOPIC SIGHT

(71) Applicant: HENSOLDT Optronics GmbH, Oberkochen (DE)

(72) Inventors: Ronald Gruner, Weilmuenster/Wolfenhausen (DE); Gerd Polzer, Asslar (DE); Timo Burzel, Lahnau (DE)

(73) Assignee: HENSOLDT Optronics GmbH, Oberkochen (DE)

( * ) Notice: Subject to any disclaimer, the term of this patent is extended or adjusted under 35 U.S.C. 154(b) by 534 days.

(21) Appl. No.: 16/487,167

(22) PCT Filed: Feb. 21, 2018

(86) PCT No.: PCT/EP2018/054237
§ 371 (c)(1),
(2) Date: Nov. 14, 2019

(87) PCT Pub. No.: WO2018/153894
PCT Pub. Date: Aug. 30, 2018

(65) Prior Publication Data

US 2021/0325147 A1 Oct. 21, 2021

(30) Foreign Application Priority Data

Feb. 22, 2017 (DE) ..... 10 2017 103 605.9

(51) Int. Cl.
*F41G 1/38* (2006.01)

(52) U.S. Cl.
CPC ..... *F41G 1/38* (2013.01)

(58) Field of Classification Search
CPC . G02B 7/00; G02B 7/004; G02B 7/16; G02B 23/00; G02B 27/36; G02B 21/241;
(Continued)

(56) References Cited

U.S. PATENT DOCUMENTS 3,037,287 A * 6/1962 Glatz ..... F41G 1/30 89/200
3,260,157 A * 7/1966 Boughton ..... G02B 21/242 359/379

(Continued)

FOREIGN PATENT DOCUMENTS

CH 399251 A 3/1966
CN 107091591 A * 8/2017 ..... F41G 1/20

(Continued)

OTHER PUBLICATIONS

Deutsches Patent—Und Markenamt, "Office Action Regarding Patent Application No. 10 2017 103 605.9", dated Nov. 2, 2017, p. 5, Published in: DE.

(Continued)

*Primary Examiner* — Joshua E Freeman
*Assistant Examiner* — Benjamin S Gomberg
(74) *Attorney, Agent, or Firm* — Neugeboren O'Dowd PC

(57) ABSTRACT

The invention relates to an adjustment apparatus of a reticle device of a telescopic sight, which is arranged in a housing of the reticle device, wherein a moving direction is converted into a translational movement by means of two regulating caps as adjusting devices via rotational movements of the regulating caps occurring in steps and wherein one of the two regulating caps has a fine adjustment and the other regulating cap has a coarse adjustment. The reticle device can be connected to the housing via an annular stationary fastening saddle on the regulating cap for the fine adjustment. The two regulating caps can be rotated independently of each other by a driving pinion and a central driving spindle. An adjusted scale position of the one regulating cap remains unchanged by the actuating of the other regulating cap.

8 Claims, 2 Drawing Sheets

(58) Field of Classification Search
CPC ..... G02B 21/242; G02B 21/248; F41G 1/16; F41G 1/18; F41G 1/20; F41G 1/38; F41G 1/387; F41G 1/393
USPC ..... 42/119–120, 122; 359/399, 421–432, 359/503, 505
See application file for complete search history.

(56) References Cited

U.S. PATENT DOCUMENTS

| | | | | | |
|---|---|---|---|---|---|
| 4,247,161 | A * | 1/1981 | Unertl, Jr. | G02B 27/36 | 359/424 |
| 8,104,217 | B2 * | 1/2012 | Huber | F41G 1/38 | 42/125 |
| 8,749,887 | B2 | 6/2014 | Jahromi | | |
| 9,574,848 | B2 * | 2/2017 | Zimmermann | F41G 1/033 | |
| 9,677,848 | B2 * | 6/2017 | Hamilton | G02B 7/004 | |
| 9,958,235 | B2 * | 5/2018 | Lassak | F41G 1/38 | |
| 9,989,362 | B2 * | 6/2018 | Ottl | G02B 23/16 | |
| 10,012,476 | B2 * | 7/2018 | Ottl | F41G 1/38 | |
| 10,145,651 | B2 * | 12/2018 | Cheng | G05G 5/065 | |
| 2009/0199452 | A1 | 8/2009 | Huber | | |
| 2012/0053878 | A1 | 3/2012 | Windauer | | |
| 2015/0323778 | A1 * | 11/2015 | Takahashi | F41G 1/38 | 359/422 |
| 2019/0310052 | A1 * | 10/2019 | Krausz | F41G 1/38 | |

FOREIGN PATENT DOCUMENTS

| | | | | | |
|---|---|---|---|---|---|
| CN | 207317635 | U * | 5/2018 | F41G 1/38 | |
| CN | 108592701 | A * | 9/2018 | F41G 1/20 | |
| DE | 102006016834 | A1 | 10/2007 | | |
| DE | 102006052143 | A1 * | 5/2008 | G02B 21/241 | |
| DE | 102009050089 | A1 | 4/2011 | | |
| DE | 102011013456 | A1 | 9/2012 | | |
| EP | 2684005 | B1 | 5/2015 | | |
| WO | WO-2019114872 | A1 * | 6/2019 | G02B 7/004 | |

OTHER PUBLICATIONS

Menier, Renan, "International Search Report and Written Opinion Regarding International Application No. PCT/EP2018/054237", dated Apr. 19, 2018, p. 14, Published in: EP.

* cited by examiner

ADJUSTMENT APPARATUS OF A RETICLE DEVICE OF A TELESCOPIC SIGHT

CROSS-REFERENCE TO RELATED APPLICATIONS

This application claims priority to International Patent Application No. PCT/EP2018/054237, filed Feb. 21, 2018, which is incorporated entirely by reference herein.

FIELD OF THE DISCLOSURE

The invention relates to an adjustment apparatus of a reticle device of a telescopic sight, said adjustment apparatus being disposed in a housing of the reticle device, wherein a regulating direction by means of two annular regulating caps as regulating drives by way of rotating movements of the regulating caps that are performed in latching steps is converted to a translatory movement, and wherein one of the two regulating caps is provided with a fine adjustment and the other regulating cap is provided with a coarse adjustment.

BACKGROUND

Adjustment apparatuses of this type are known, for example, from DE 10 2011 013 456 A1, DE 10 2009 050 089 A1, DE 10 2006 016 834 A1, EP 2 684 005 B, and U.S. Pat. No. 4,247,161.

By way of adjustment apparatuses of this type, a defined angular position by a rotating movement about an axis is to be converted to a defined linear adjustment for an axial movement. The axial movement in this instance acts on the positioning of a target-indicating element such as, for example, a reticle plate, which is preferably situated in at least one picture plane of an aiming device.

The rotating movement of a regulating drive is generally converted to the required axial movement by way of a spindle thread having a defined pitch.

The setting of a target-indicating element, for example the reticle plate as part of an aiming installation, follows the ballistic projectile trajectory of a projectile which is accelerated from the weapon barrel that is operatively connected to the aiming device.

The projectile trajectory depends on various parameters and can be configured in various ways. It is one of the objects of the aiming device herein to enable the shooter to be able to bring the visual target line to an intersection point with the projectile trajectory, said intersection point being able to be directed at a predefined distance at a predefined target point. To this end, a defined setting of the angle between the target line and the barrel bore axis is required. In the case of long-range precision handguns this angle can be up to a value of at least 4 m@100 m. The associated angular resolution herein is usually 0.1 mrad or 0.05 mrad. In this way, up to 400 or 800, respectively, defined latching positions result for a distance setting that follows the projectile trajectory.

To this end, it is known for the reticle device to be utilized for setting the gun sight angle, said reticle device being able to be adjusted in defined manner about an axis. However, the number of latches per revolution of the regulating cap of the reticle device herein should ideally be limited. Specifically, the diameter of the regulating cap should not exceed a specific dimension for ergonomic considerations. It is to be noted here that the radian measure per latch that results on account of the number of latches substantially influences the tactile feedback required. For this reason, a distribution of the required latching steps across more than one complete revolution inevitably results on account thereof. On account thereof, it is disadvantageous herein that it is necessary for a revolution indicator to be utilized, said revolution indicator indicating in a visual and optical manner to the user in which revolution the adjustment of the reticle device is currently situated, and specifically without any adjustment of the target line having to be performed for the purpose of indication or orientation, respectively.

In practice, it has now been demonstrated to be necessary for an intended latching position to be reached as fast as possible, despite a high latching resolution and a simultaneously large adjustment range, and specifically even when the latch-synchronous engraving on the regulating cap cannot be visually perceived. For this purpose, it is known for an additional function which acts so as to be latch-synchronous and which generates an additional tactile feedback every ten clicks to be installed (decimal adjustment) in order to be able to perform the linear adjustment of the target line in a more rapid manner.

However, this means that complex additional functions are required in order for the high number of latches to be designed so as to be manageable by a user.

It is also known for an additional mechanical construction element, for example in the form of an indicator pin, to be used for a revolution indication, said mechanical construction element protruding from the dimensions of the adjustment apparatus so as to correspond to the number of revolutions of the regulating cap to be indicated. The revolution position of the regulating cap can then be read in a visual and tactile manner using the length of the protruding construction element as an indicator. It is however disadvantageous herein that said additional indicator construction elements are sensitive to the effect of external forces and in some instances also cannot be read with the required unambiguity without visual contact.

The tactile feedback for the decimal and the single latching action by way of a regulating cap disadvantageously also leads to a high complexity in terms of precision in the design and the production. Every tenth latching position herein is usually configured so as to be noticeably more resistant than the latching position 10±1 or 20±1, for example. In use, this nevertheless often leads to excessive controlling actions, setting errors, or counting errors.

Example:

In order for an adjustment resolution of 0.1 to be able to be implemented in a defined adjustment range of 36 mrad, 360 latches plus one 1 mrad additional latch (decimal adjustment), plus the installation of a revolution indicator, are required in the case of the known adjustment apparatuses. In the distribution across at most two complete circular revolutions having in each case 180 latches, the latching action angle is 2°, which is considered marginal for a manual operation with an ergonomic or usually manageable, respectively, regulating cap diameter. Counting errors or setting errors, respectively, therefore also often arise in the case of these fine latching resolutions in one revolution.

For an ideally precise adjustment in the case of the adjustment apparatus it is also known for the rotating movements of the regulating caps to be performed by a coarse adjustment using one regulating cap and a fine adjustment using the other regulating cap.

SUMMARY OF THE INVENTION

The present invention is based on the object of eliminating the aforementioned disadvantages of the prior art, in particular of achieving a reduction in the number of effective latches while maintaining a latching resolution of, for example, 0.1 mrad or 0.05 mrad, respectively, while maintaining the required reticle adjustment path or adjustment angle, respectively. At the same time, the adjustment apparatus is to be simple to assemble and also to replace or repair when required.

According to the invention, this object is achieved by an adjustment apparatus for adjusting a reticle device of a telescopic sight in that the adjustment apparatus by way of an annular fastening saddle which is connected to one of the two regulating caps is connected to the housing of the reticle device, wherein the two regulating caps by way of an entrainment drive and a central driving spindle are rotatable in a mutually independent manner, and wherein a set scale position of the one regulating cap remains unchanged by the activation of the other regulating cap.

On account of the division according to the invention of the translatory movement to two regulating caps as regulating drives having dissimilar adjustment graduations, the effective number of latches can be very significantly reduced while maintaining an adjustment resolution per latch of, for example, 0.1 mrad and while maintaining the required adjustment range.

Example:

The regulating cap for the coarse adjustment by way of the manually settable rotation angle enables a number of latches of 36 latches at a latching resolution of 1 mrad per latch. The regulating cap for the fine adjustment by way of the manually settable rotation angle enables an adjustment range of 20 latches (±10 latches) at a resolution of 0.1 mrad per latch. This means that the number of latches is reduced from to date 360 latches to only 36+20=56 latches. The overall number of latches for the usual ballistically utilizable adjustment range is thus reduced by approx. 85%.

The fine adjustment of the regulating cap for the fine adjustment can be scaled, for example, at a resolution of 0.1 mrad from −10 via 0 to +10 latches. On account of the decimal distribution of the number of latches to the coarse adjustment and the fine adjustment, the multiple rotation of a regulating cap having a high number of latches and the indication requirements associated therewith become superfluous. Moreover, a reduction of the adjustment angle even below 180° is possible for both regulating drives.

Overall, a significant enlargement of the latching angle (regulating angle between two latching positions), an unambiguous positioning capability, and a simple adjustment result in this way.

On account of the design embodiment according to the invention of the adjustment apparatus, a set scale position of the one regulating cap remains unchanged by the activation of the other regulating cap. This means that the two rotating movements of the regulating drives can thus be carried out in a mutually independent manner.

On account of the annular fastening saddle according to the invention, said fastening saddle being connected to one of the two regulating caps, the adjustment apparatus by virtue of the connection of said fastening saddle to the housing can be push-fitted as a complete unit into the housing. This can be performed, for example, by way of an annular collar on the fastening saddle, said annular collar having a thread by way of which the adjustment apparatus is then screw-fitted into the housing of the reticle device. The fastening saddle is preferably connected to the regulating cap for the fine adjustment.

The rotation axes of the two regulating caps are advantageously concentric. The rotating movements of the two regulating caps can be transmitted in a resulting adjustment value to an image-erecting system with reticles.

A very advantageous design embodiment of the invention can lie in that, for the purpose of referencing the line marking position in relation to the position of a weapon barrel, the operative connection between the regulating caps is releasable and the regulating caps are rotatable to a defined scale position, on account of which no unintentional adjustment value is transmitted to the image-erecting system with reticles.

When the regulating caps conjointly with the annular regulators thereof having the encircling engravings are configured so as to be releasable from the adjustment mechanism, the scales on the regulating caps can be set to zero without the regulating drive per se being activated, the axis being adjusted on account of the latter.

The purpose of this design embodiment is that the target system for the telescopic sight can be calibrated.

The adjustment apparatus of the reticle device lies so as to be parallel to the optical axis. This means that the target system first has to be aligned to "0". To this end, a line mark having a basic adjustment in relation to the weapon barrel has to be established. This means that the target cross has to be set to the point of entry, whereupon the engraved position is set to "0" and is subsequently fixed.

For a metric embodiment of the adjustment apparatus, the latching ratio between the coarse drive and the fine drive can have a ratio of 1:10, wherein the regulating cap is provided for a coarse adjustment of 1 mrad and the regulating cap is provided for a fine adjustment with latching steps of 0.1 mrad.

The adjustment apparatus according to the invention is provided for a telescopic sight. Of course, other potential applications are also provided in the scope of the invention. This relates, for example, to target devices which function digitally or perform a digital adjustment, respectively. To this end, a rotary encoder, a type of decoder, is provided, wherein an electronic adjustment is performed by a reticle plate which is moved on a display. No optical component parts per se are mechanically moved herein, but in order for a haptic sense to continue to be present to the operator, a reticle plate in this instance is not simply adjusted by keys but the regulating mechanism according to the invention is maintained.

BRIEF DESCRIPTION OF THE DRAWINGS

An exemplary embodiment of the invention is described in principle hereunder by means of the drawing.

In the drawing.

DETAILED DESCRIPTION

Figure 1:
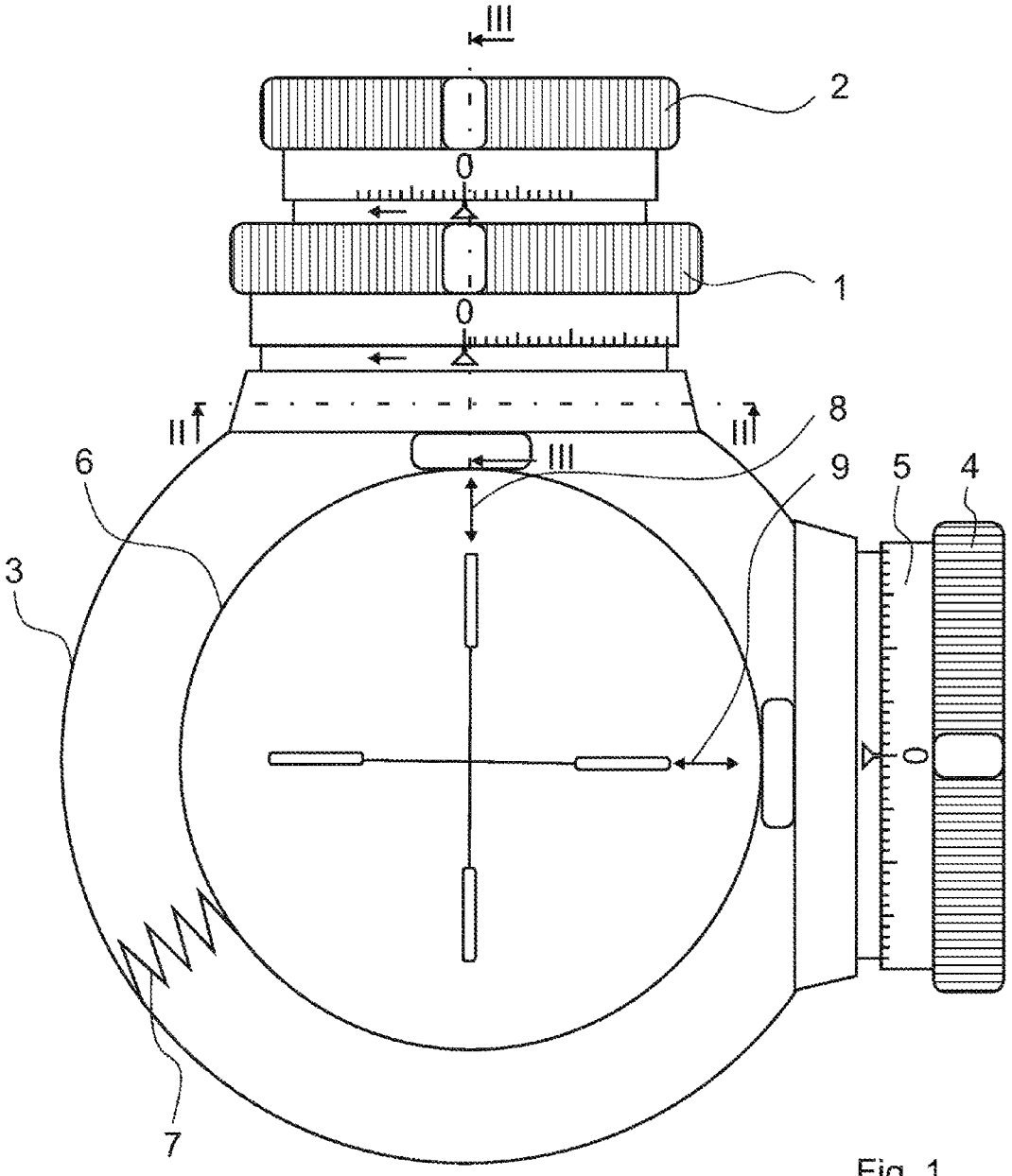
FIG. 1 shows a view of the adjustment apparatus.

In principle, the construction and the operating mode of an adjustment apparatus for regulating a reticle device is generally known (for example from DE 10 2011 013 456 A1) which is why only parts that are relevant to the invention will be discussed in more detail hereunder.

The adjustment apparatus of the reticle device for adjusting a telescopic sight has a first axially rotating regulating cap 1 as the regulating drive for a fine adjustment, and a second likewise axially rotating regulating cap 2 as the regulating drive for a coarse adjustment. The regulating cap 2 has an axially rotating latching pitch of 1 mrad, for example. The regulating cap 2 on the circumference thereof has a latch-synchronous scale of 1 mrad. The graduation is provided with 36 individual latching steps, for example. A delimitation by a detent on both sides is provided herein.

The adjustment apparatus is disposed in a housing 3 of the reticle device. Apart from the two regulating caps 1 and 2 for the reticle adjustment of "height", the reticle device is also provided with a further regulating cap 4 having a scale graduation 5 for a reticle adjustment of "side".

The rotation axes of the two regulating caps 1 and 2 are advantageously concentric.

The regulating cap 1 has an axially rotating latching pitch of 0.1 mrad, for example. The regulating cap 1 on the circumference thereof has a latch-synchronous scale of 0.1 mrad. Overall, 20 individual latching steps which are in each case also provided with the tactile click are provided, for example. The latching steps herein in both rotating directions can be provided between −10 and +10 latches, wherein a delimitation by a detent on both sides is likewise present.

The rotating movements of the two regulating caps 1 and 2 in a known manner are converted to an axial movement by way of a coupling part, for example a spindle drive.

An image-erecting system having reticles 6 having a restoring spring 7 is disposed in a known manner in the interior of the housing 3. An arrow 10 in the figure shows the adjustment direction of the reticle in the vertical direction, and an arrow 9 shows the adjustment direction of the reticle in the lateral direction.

Figure 2:
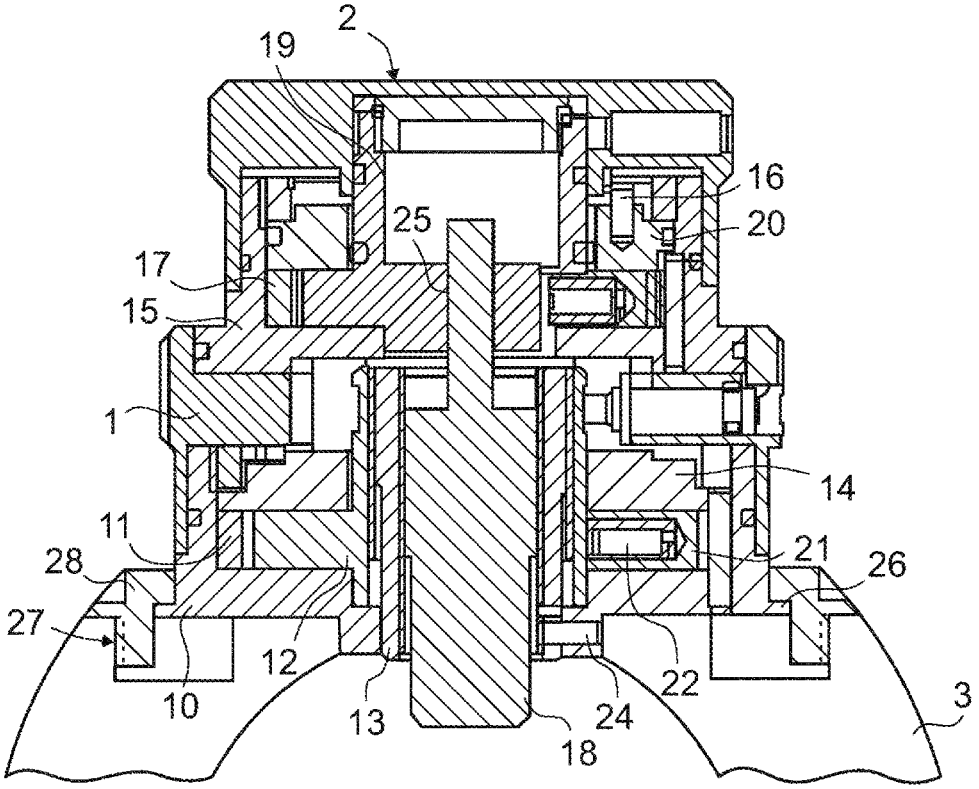
FIG. 2 shows a section along the line II-II in FIG. 1.
Figure 3:
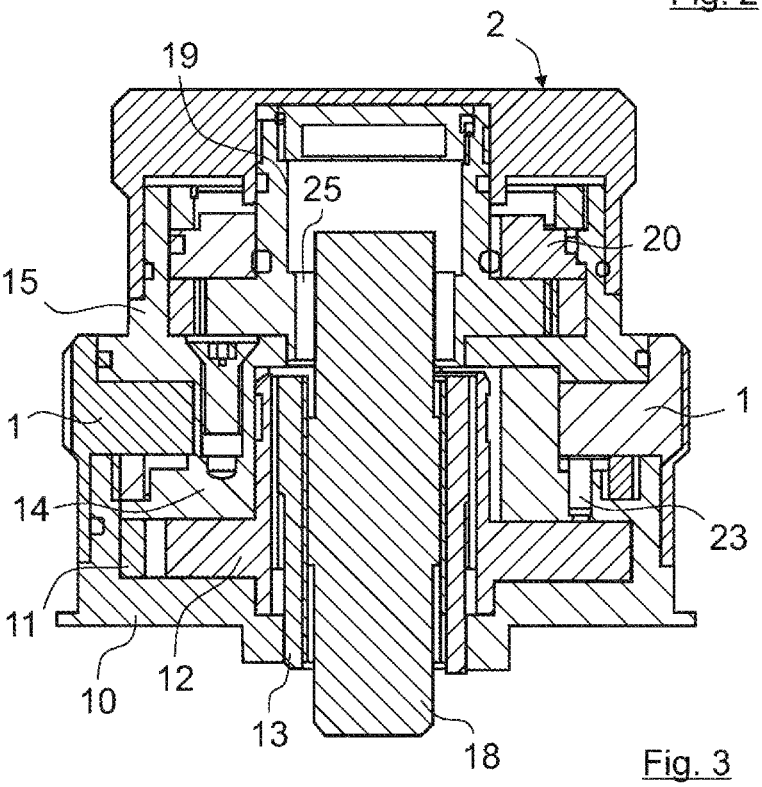
FIG. 3 shows a section along the line III-III in FIG. 1.

A constructive embodiment of the adjustment apparatus is described by way of example in more detail hereunder by means of FIGS. 2 and 3.

The construction and the function of the adjustment apparatus can be subdivided into four groups, specifically:

1. Stationary construction elements
2. Construction elements having a rotatingly revolving movement
3. Latching elements
4. Construction elements having a translatory movement Pertaining to 1:

The stationary construction elements in a force-fitting, form-fitting, or friction-fitting, positionally oriented manner are fixedly connected to the housing 3 of the opto-optronic primary construction group of the aiming device. The stationary construction elements serve for the positional orientation, the positioning, and the guiding of the rotatingly revolving moving elements as well as for receiving the stationary latching function.

An arrow 8 in FIG. 1 shows the movement direction of the reticle in the vertical direction, and an arrow 9 shows the movement direction in the lateral direction.

The stationary primary construction elements possess a fastening saddle 10 which is connected to the regulating cap 1 for the fine adjustment and which supports the overall construction of the adjustment apparatus. The fastening saddle 10 serves for fixedly connecting the entire adjustment apparatus to the housing 3 of the reticle device of the opto-optronic primary construction group of the aiming device. The fastening saddle 10 as a stationary part has a latching ring 11 and as rotating parts guides a threaded piece 12 and the regulating cap 1 for the fine adjustment as well as an axial guide of the lifting movement of a threaded sleeve 13.

Instead of a connection to the regulating cap 1 for the fine adjustment, said fastening saddle 10 can of course also be connected to the regulating cap 2 for the coarse adjustment, wherein in this case the regulating cap 2 is disposed at the bottom and the regulating cap 1 is disposed at the top in the adjustment apparatus.

An annular intermediate saddle 14 as the stationary component separates the functional parts of the coarse adjustment and the fine adjustment and is fixedly connected to the fastening saddle 10. The intermediate saddle 14 receives the detent function for the adjustment delimitation of the fine adjustment.

An annular saddle 15 for the coarse adjustment guides the rotating movement of the regulating cap 2 and for receiving the stationary latching ring 17 for the coarse adjustment is fixedly connected to the intermediate saddle 14.

Pertaining to 2:

The rotatingly revolving moving elements follow a manual torque that is introduced at the associated external parts and transmits said torque in a circular movement that is performed about a centrally positioned rotation axis. The manual torque by way of two regulating elements can arise in a mutually independent or separate manner, respectively, specifically for the regulating cap 1 for the fine adjustment and the regulating cap 2 for the coarse adjustment. The rotation of both moving functional groups by way of the differential lifting function of the threaded sleeve 13 is transmitted to the lifting movement of a driving spindle 18.

Pertaining to 3:

The separated rotating movement of the fine adjustment and the coarse adjustment is in each case transmitted to a directly assigned revolving component by way of an operative connection, specifically the threaded piece 12 and an entrainment drive 19. The entrainment drive 19 is provided with an annular guide part 20. The guide part 20 serves for axially guiding the entrainment drive 19, for fixing the latching ring 17, and as a detent for the regulating cap 2 for the coarse adjustment.

The entrainment drive 19 is connected to the regulating cap 2 for the coarse adjustment. The driving spindle 18 in the region of an internal recess 25 of the entrainment drive 19 is machined and provided with two flanks (cf. FIG. 3). The machined feature of the central driving spindle 18 fits in the recess 25 of the entrainment drive 19. When the regulating cap 2 of the coarse adjustment now is activated the driving spindle 18 is imparted only rotation but no vertical lift because the machined feature is longer than the height of the recess 25 and, on account thereof, permits axial displacements. An uncoupling of the two regulating drives takes place in this way.

A dedicated scale in dex is assigned to each regulating drive, wherein a respective assigned indexing can be performed for each of the two scales on account of the uncoupling of said regulating drives.

The threaded sleeve 13 by the cylindrical pin 24 that presses on the threaded sleeve 13 is adjusted only in terms of the height and therefore is not imparted any rotating movement.

A latching segment having spring-restoring mechanism is in each case guided by a latching piece 21 having a compression spring 22 in the revolving components.

Said conjointly revolving latching segments in stationary latching rings 11 and 17 which have a uniformly disposed internal toothing and are in each case provided to this end in the same plane carry out a division of the rotating movement. This division as a defined scale interval serves the user for precisely setting a previously known angular value or distance value, respectively, and becomes noticeable as a tactile feedback when introducing the manually performed rotating movement or rotary movement, respectively, of the regulating cap 1 for the fine adjustment and the regulating cap 2 for the coarse adjustment.

Pertaining to 4:

It is the primary function of the described adjustment apparatus to enable a defined and precise adjustment of a reference marking, for example a hair cross, that is disposed in the optical or optronic, respectively, beam path of the housing 3 relative to an image within a mechanically predefined adjustment range, as illustrated by way of the beam path. In this specific application described here, this requires a conversion of the rotating movement of the coarse adjustment and the fine adjustment in a manner divided by the latches to a translatory movement along said centrally disposed rotation axis.

The division according to the invention of the adjustment function into a coarse drive and a fine drive in the mode of conversion illustrated here is implemented by means of the threaded sleeve 13 which is provided with an internal thread and an external thread. The internal thread and the external thread have dissimilar thread pitches, the mutual difference in the pitches significantly determining the difference in the adjustment between the coarse drive and the fine drive.

For the coarse adjustment by way of the regulating cap 2, the centrally disposed driving spindle 18 that is provided with an external thread (large pitch), when activated, by way of an entrainment function that in a form-fitting manner is disposed in the upper part, receives the rotating movement of the threaded piece 12 and by way of the internal thread of the threaded sleeve 13 directly transmits an axial movement. The threaded sleeve 13 herein carries out neither a rotating nor an axial movement.

A detent pin 23 as a detent is axially pushed against the regulating cap 1 for the fine adjustment. The threaded sleeve 13 by way of a cylindrical pin 24 which is radially pushed against said threaded sleeve 13 and which as a stationary guide part is fastened in the fastening saddle 10 for the fine adjustment is prevented from performing a rotating movement.

A detent pin 16 as a detent for delimiting a rotation is axially pushed against the regulating cap 2 for the coarse adjustment.

The rotating movement of the regulating cap 1 for the fine adjustment is transmitted to the threaded piece 12 that is operatively connected to said regulating cap 1. The threaded piece 12 is provided with an internal thread, the counter piece thereof, having a precisely matching fit, being situated on the external diameter of the threaded sleeve 13. On account of the axial degree of freedom of the threaded sleeve 13 present, the rotating movement of the threaded piece 12 can now be converted to an axial movement of the threaded sleeve 13.

The threaded sleeve 13 in the axial movement carried out is prevented from performing a rotating movement by way of the cylindrical pin 24 which is disposed in the stationery fastening saddle 10 for the fine adjustment. The centrally disposed driving spindle 18 which by way of a thread having a precisely matching fit is positioned in the internal diameter of the threaded sleeve 13 herein maintains the axial relative position in relation to said threaded sleeve 13 by way of a form-fitting entrainment function that is disposed in the upper part.

In this way, the rotating movements that are performed in a mutually independent manner on the coarse drive and the fine drive add up so as to form a resulting axial positional modification which by way of a lower planar face of the driving spindle 18 is transmitted to the mechanical-optical components of the target-line-relevant or target-line-depicting, respectively, components of the primary functional groups of the apparatus.

The fastening saddle 10 on the external circumference thereof at the end that faces the housing 3 is provided with an extension 26, preferably in the form of a ring. An annular collar 27 is push-fitted over the extension 26 of the fastening saddle 10. The annular collar 27 on the external circumference thereof possesses a thread which can be screw-fitted into a threaded bore of the housing 3. In this way, the adjustment apparatus as a complete unit is able to be connected to the housing 3. To this end, the annular collar 27 by way of an inwardly protruding annular shoulder 28 engages across the extension 26, on account of which the fastening saddle 10 and thus the entire adjustment apparatus when screw-fitting the annular collar 27 is positioned in the housing 3 in the reticle device.

LIST OF REFERENCE SIGNS

1,2 Regulating caps
3 Housing
4 Regulating cap for lateral adjustment
5 Scale graduation
6 Image-erecting system with reticles
7 Restoring spring
8,9 Arrows for indicating the movement directions
10 Fastening saddle
11 Latching ring for fine adjustment
12 Threaded piece
13 Threaded sleeve
14 Intermediate saddle
15 Annular saddle
16 Detent pin
17 Latching ring for coarse adjustment
18 Driving spindle
19 Entrainment drive
20 Guide part for entrainment drive
21 Latching piece
22 Compression spring
23 Detent
24 Cylindrical pin
25 Recess
26 Extension
27 Annular collar
28 Annular shoulder

The invention claimed is:

1. An adjustment apparatus for a reticle device of a telescopic sight, said adjustment apparatus being disposed in a housing of the reticle device, the adjustment apparatus comprising:

a first regulating cap configured to be rotated by way of first rotating movements in first latching steps, wherein the first regulating cap is utilized for a fine adjustment of the reticle device of the telescopic sight, the fine adjustment corresponding to a first latching resolution;

a second regulating cap configured to be rotated by way of second rotating movements in second latching steps, wherein the second regulating cap is utilized for a coarse adjustment of the reticle device of the telescopic sight, the coarse adjustment corresponding to a second latching resolution;

an annular fastening saddle, wherein the annular fastening saddle is connected to the housing and coupled to the first regulating cap;

an entrainment drive, wherein the entrainment drive comprises an internal recess, and wherein the entrainment drive is connected to the second regulating cap;

a central driving spindle, wherein the central driving spindle is positioned in the internal recess of the entrainment drive, and wherein the central driving spindle includes a machined feature and two flanks, wherein the machined feature of the central driving spindle fits in the internal recess of the entrainment drive, and wherein the machined feature is longer than a height of the internal recess; and a threaded sleeve, the threaded sleeve having an internal thread and an external thread, wherein the threaded sleeve is connected to the central driving spindle;

wherein the first rotating movements of the first regulating cap are converted to first translational movements of the reticle device via the central driving spindle, wherein the second rotating movements of the second regulating cap are converted to second translational movements of the reticle device via the central driving spindle, wherein the first regulating cap and the second regulating cap are rotatable in a mutually independent manner by way of the entrainment drive and the central driving spindle, wherein a set scale position of one of the first regulating cap and the second regulating cap remains unchanged by activation of another one of the first regulating cap and the second regulating cap, wherein the threaded sleeve is connected to the central driving spindle for transmitting the first rotating movements and the second rotating movements of the first regulating cap and the second regulating cap, respectively, wherein the threaded sleeve includes the internal thread for the coarse adjustment and the external thread for the fine adjustment for dividing an adjustment function into a coarse drive and a fine drive, respectively, wherein the internal thread of the threaded sleeve comprises a first pitch and the external thread of the threaded sleeve comprises a second pitch, the second pitch different from the first pitch, wherein, when the second regulating cap is rotated for the coarse adjustment, the central driving spindle is configured such that only a rotating movement of the central driving spindle results, and wherein the central driving spindle is further configured to enable uncoupling of the coarse drive and the fine drive.

2. The adjustment apparatus of claim 1, wherein the internal thread of the threaded sleeve is operatively connected to an external thread of the central driving spindle for the coarse adjustment by the second regulating cap.

3. The adjustment apparatus of claim 1, wherein the annular fastening saddle is connected to an annular collar, and wherein the annular collar is screw-fittable into a threaded bore of the housing.

4. The adjustment apparatus of claim 1, wherein the entrainment drive is configured to be axially guided by a guide part.

5. The adjustment apparatus of claim 4, wherein the guide part forms a detent for the second regulating cap utilized for the coarse adjustment.

6. The adjustment apparatus of claim 1, wherein the first regulating cap utilized for the fine adjustment is operatively connected to a threaded piece for transmission of the first rotating movements of the first regulating cap, and wherein an internal thread of the threaded piece is operatively connected to the external thread of the threaded sleeve.

7. The adjustment apparatus of claim 1, wherein an operative connection between the first regulating cap and the second regulating cap is releasable, and wherein each of the first regulating cap and the second regulating cap are rotatable to a respective set scale position.

8. The adjustment apparatus of claim 1, wherein, a latching ratio between the coarse drive and the fine drive is a ratio of 1:10, the first regulating cap utilized for the fine adjustment provides the first latching resolution, and wherein the first latching resolution is 0.1 mrad per latching step, and the second regulating cap utilized for the coarse adjustment provides the second latching resolution, and wherein the second latching resolution is 1 mrad per latching step.

* * * * *